US010279232B2

(12) United States Patent
Pope

(10) Patent No.: US 10,279,232 B2
(45) Date of Patent: May 7, 2019

(54) GOLF SWING ALIGNMENT TOOL, KIT INCLUDING SAME, AND METHOD OF USING SAME

(71) Applicant: Shawn Patrick Pope, Belle, MO (US)

(72) Inventor: Shawn Patrick Pope, Belle, MO (US)

( * ) Notice: Subject to any disclaimer, the term of this patent is extended or adjusted under 35 U.S.C. 154(b) by 0 days.

(21) Appl. No.: 15/728,201

(22) Filed: Oct. 9, 2017

(65) Prior Publication Data

US 2018/0193709 A1 Jul. 12, 2018

Related U.S. Application Data

(63) Continuation-in-part of application No. 15/210,116, filed on Jul. 14, 2016, now abandoned.

(51) Int. Cl.
*A63B 57/13* (2015.01)
*A63B 57/19* (2015.01)

(52) U.S. Cl.
CPC ..... *A63B 57/13* (2015.10); *A63B 57/19* (2015.10)

(58) Field of Classification Search
CPC ..... A63B 57/13; A63B 57/19; A63B 57/10; A63B 57/20; A63B 69/3623
USPC ..... 224/918
See application file for complete search history.

(56) References Cited

U.S. PATENT DOCUMENTS 152,218 A 6/1874 Dickenson, Jr.
1,623,119 A 4/1927 Kearney
1,717,962 A 6/1929 Deike
1,761,532 A * 6/1930 Morris ..... A63B 57/10 473/218
2,096,055 A * 10/1937 Miller ..... A63B 57/10 473/257
2,121,113 A 6/1938 Barr
2,165,479 A * 7/1939 Hallberg ..... A63B 57/10 473/257
D158,622 S * 5/1950 Sherwin ..... 473/261
3,347,551 A * 10/1967 Dreyfus ..... A63B 57/10 473/257
3,406,978 A 10/1968 Johnson, Jr.
3,540,727 A * 11/1970 Hoe, Jr. ..... A63B 57/0037 224/918
3,675,929 A * 7/1972 Guarino, Sr. ..... A63B 57/10 473/257
3,883,144 A * 5/1975 Lazow ..... A63B 57/10 473/218
3,966,214 A 6/1976 Collins
4,181,311 A * 1/1980 Lawlor ..... A63B 69/3661 473/257
4,645,208 A 2/1987 Morabeto
(Continued)

*Primary Examiner* — Steven B Wong
(74) *Attorney, Agent, or Firm* — Carrier Blackman & Associates, P.C.; William D. Blackman; Joseph P. Carrier

(57) ABSTRACT

A golf swing guide tool is configured for use with a golf tee, and includes an elongated pointer body having a front end, a medial portion and a rear end, the pointer body having a longitudinal axis. The front end of the pointer body is tapered to a point at a tip portion thereof which is disposed on the longitudinal axis. The medial portion of the pointer body has a central hole formed therein which is aligned with the longitudinal axis, and which is configured to slidably receive a shaft portion of a golf tee therein to form a working configuration in which the tee is oriented substantially perpendicular to the longitudinal axis of the pointer body. A method of using the golf swing guide tool is also described.

5 Claims, 15 Drawing Sheets

(56) References Cited

U.S. PATENT DOCUMENTS

D293,261 S * 12/1987 Sadowski ..... D21/794
D307,929 S * 5/1990 Parkerson ..... D21/791
4,960,239 A * 10/1990 Wait ..... A63B 57/50 224/918
5,226,647 A * 7/1993 Notarmuzi ..... A24F 13/22 15/236.08
5,240,254 A * 8/1993 Adlam ..... A63B 57/10 473/257
D347,457 S * 5/1994 Armstrong, III ..... D21/791
5,437,448 A * 8/1995 Balson ..... A63B 69/3623 473/257
5,492,330 A * 2/1996 Eldridge, Jr. ..... A63B 57/00 473/265
5,755,629 A 5/1998 Blomgren
D428,954 S * 8/2000 Tate ..... D21/793
6,217,465 B1 4/2001 Kenia, Jr.
6,224,502 B1 5/2001 Warfield
6,769,999 B1 * 8/2004 Chase ..... A63B 57/10 473/257
6,899,644 B1 5/2005 Song et al.
7,806,786 B2 * 10/2010 Joffe ..... A63B 57/10 473/386
7,846,034 B1 * 12/2010 Lightfoot ..... A63B 57/00 473/257
7,914,398 B2 * 3/2011 Tuck ..... A63B 69/3623 473/397
8,439,771 B1 5/2013 Fleming
9,216,338 B1 12/2015 Lee et al.
2005/0009645 A1 * 1/2005 Isabell ..... A63B 69/3694 473/400
2005/0233837 A1 * 10/2005 Jung ..... A63B 69/3623 473/386
2007/0270246 A1 11/2007 Salmon
2009/0264224 A1 10/2009 Whitehouse
2014/0378247 A1 12/2014 Lee

* cited by examiner

FIG-2A
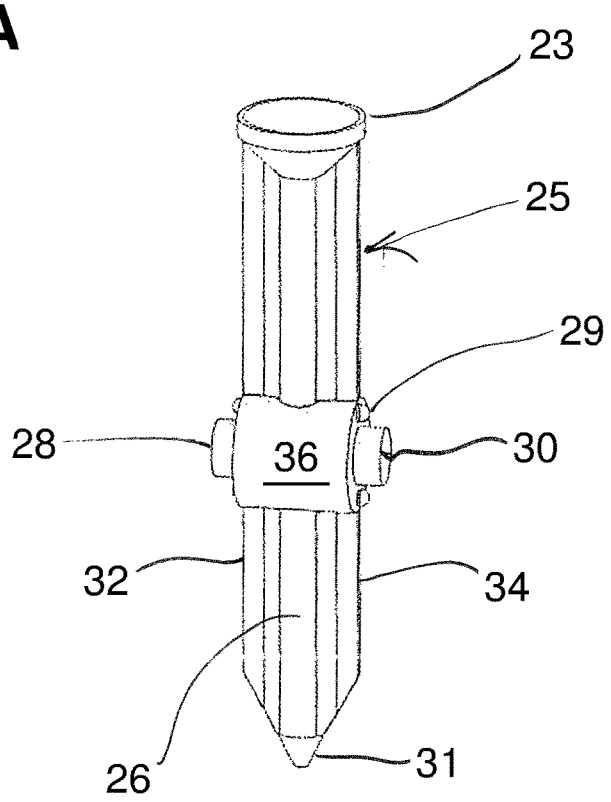
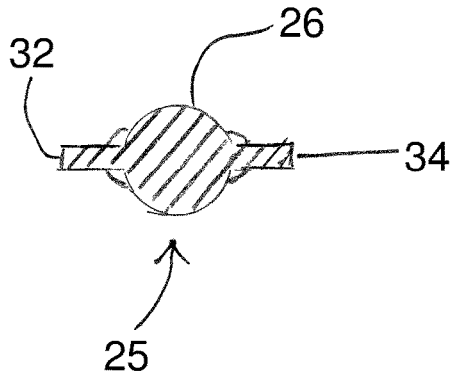
FIG-1A

GOLF SWING ALIGNMENT TOOL, KIT INCLUDING SAME, AND METHOD OF USING SAME

CROSS-REFERENCE TO RELATED APPLICATIONS

The present application is a continuation-in-part of, and claims priority under 35 USC 119 from U.S. patent application Ser. No. 15/210,116, filed Jul. 14, 2016. The entire disclosure of this priority document, including specification, claims, and drawings, is incorporated by reference herein.

BACKGROUND OF THE INVENTION

1. Field of the Invention

The present invention relates to a golf swing alignment tool, to a kit including the golf swing alignment tool, and to a method of using the golf swing alignment tool. In a first embodiment, the present invention relates to a combined golf tee and swing alignment tool, which is pivotally adjustable between a storage position and a working position. In a second embodiment, the swing alignment tool can be used with a standard golf tee, which may be obtained separately.

2. Description of the Background Art

A number of different golf tees are known for use in golfing to stabilize a golf ball above ground level during the initial drive of a hole, such as, for example, U.S. Pat. No. 8,439,771 to Fleming, and the other references cited therein.

Although the known golf tees are useful for their intended purposes, a need still exists in the art for a golf tee apparatus with an adjustable pointing mechanism. In particular, there is a need for an improved golf tee of the type described, which is pivotally adjustable between a storage position and a working position, and to a method of using such a golf tee.

SUMMARY OF THE INVENTION

Accordingly, it is an object of the present invention to provide a golf swing guide tool usable with a conventional golf tee, and to a method of using the swing alignment tool. It is another object of the present invention to provide a combined golf tee and golf swing guide tool, and to a method of using the swing alignment tool with the golf tee installed therein.

In a first embodiment of the invention, a golf swing guide tool is adjustable between a storage position and a working position.

A golf swing guide tool according to an illustrative embodiment of the present invention includes a pointer body having a longitudinal axis, a central hole formed therein which is configured to receive a shaft portion of a golf tee, and a front end tapered to a point at a tip portion thereof which is disposed on the longitudinal axis.

In another aspect of the invention, the pointer body has a front end, a medial portion and a rear end, the medial portion having the central hole formed therein, the central hole being aligned with the longitudinal axis and configured to slidably receive a shaft portion of a golf tee therein to form a working configuration in which the tee is oriented substantially perpendicular to the longitudinal axis of the pointer body.

In another aspect of the invention, the pointer body includes at least one boss formed from a flexibly resilient material, the boss attached to the medial portion of the pointer body and extending outwardly thereon, the boss including two spaced apart clip members defining a space therebetween configured to receive the shaft of the golf tee in a storage configuration in which the tee is oriented substantially parallel to the longitudinal axis of the pointer body.

In still another aspect of the invention, the pointer body includes a base frame portion extending around a hollow space, the base frame portion including two spaced-apart parallel side sections, the front tip disposed substantially midway between the two side sections, and a rear segment connecting rearward end portions of the side sections.

In still another aspect of the invention, the at least one boss includes a pair of bosses formed proximate the medial portion of the base frame portion and cooperating to define at least one hollow aperture therebetween to receive the shaft of the tee therein, the hollow aperture disposed inside of the hollow space, and in this aspect, the bosses are formed integrally with the base frame portion of the pointer body.

Method

A further aspect of the present invention relates to a method of hitting a golf ball off of a golf tee mounted in the golf swing guide tool in the working configuration thereof.

The method includes a first step of arranging the apparatus with the shaft portion of the tee inserted through the central hole and oriented substantially vertically.

The method includes a second step of inserting the shaft of the tee into a selected ground area until the pointer body contacts the ground surface.

The method includes a third step of placing a golf ball on to a cup portion of the tee, and a fourth step of orienting the pointer body in a direction facing toward a selected target, whereby the pointer body functions as a targeting device and an alignment gauge for aligning a swing path of a golf club, a portion of the swing path being substantially aligned with the longitudinal axis of the pointer body.

The method also includes a fifth step of passing the golf club over the swing path indicated by the pointer body, and a final step of hitting the golf ball off of the golf tee apparatus and toward the target.

For a more complete understanding of the present invention, the reader is referred to the following detailed description section, which should be read in conjunction with the accompanying drawings. Throughout the following detailed description and in the drawings, like numbers refer to like parts.

BRIEF DESCRIPTION OF THE DRAWINGS

FIG. 1A is a cross-sectional view of a shaft portion of the golf tee apparatus of FIG. 1, taken along the line 1A-1A.

FIG. 2A is a perspective view of a main tee body, which is a first component of the apparatus of FIG. 1.

DETAILED DESCRIPTION OF ILLUSTRATIVE EMBODIMENTS

First Embodiment

Figure 1:
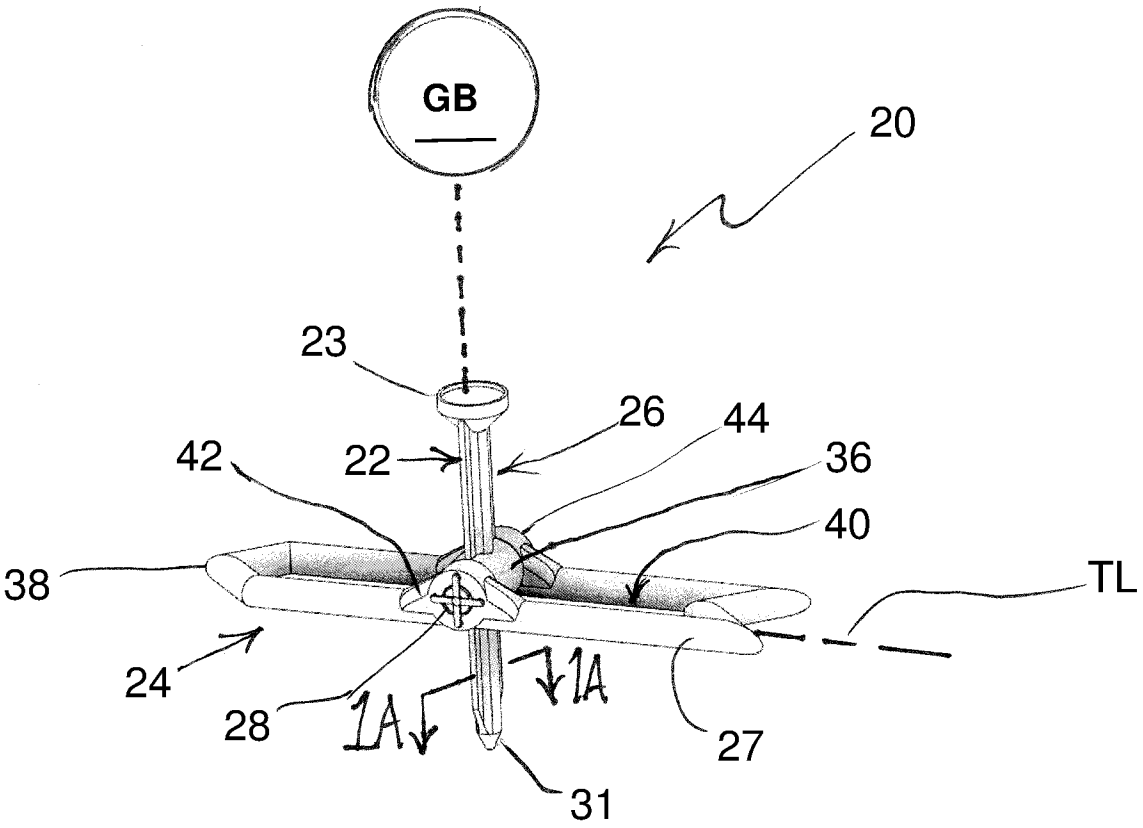
FIG. 1 is a first perspective view of a golf tee apparatus according to a first illustrative embodiment of the invention, with a main tee body shown deployed in a working position.

Referring now to FIGS. 1-4 of the drawings, a golf tee apparatus according to a first illustrative embodiment of the invention is shown generally at 20, oriented in a working position. The golf tee apparatus includes a tee body 22 and a pointer frame 24, which receives the tee body therein in a pivotally adjustable manner, to be described further herein. The apparatus 20 according to the present invention may be made of wood or plastic, as desired.

The tee body 22 includes an upper cup portion 23 having a hollow, substantially concave opening formed therein to accept and supportively hold a golf ball GB during use during preparation for a drive. It will be understood that the golf ball GB is shown in the drawings to help illustrate the application of the golf tee apparatus 20, but does not form a part of the invention, per se.

The tee body 22 also includes a shaft 25 having a center pin 26 designed to be inserted in the ground, and further includes a pair of coaxial support posts 28, 30 (FIG. 2A) integrally formed with, and extending transversely outwardly from the shaft 26. The shaft 25 includes a tapered tip portion 31 configured to be inserted into the ground, in a manner similar to a standard tee.

Optionally, but not necessarily, the tee body 22 may also include a pair of opposed vertical blades 32, 34 (FIG. 1A, 2A) integrally formed with, and extending outwardly on opposite sides of the center pin 26. Where used, the blades 32, 34 help to stabilize the tee body 22 in the ground, when inserted therein for use. In addition, the tee body 22 may optionally include a cylindrical rotary drum 36 integrally formed with, and located at a medial portion of the shaft 25. Where the rotary drum 36 is used, the support posts 28, 30 extend coaxially outwardly on opposite sides of the rotary drum.

Figure 2B:
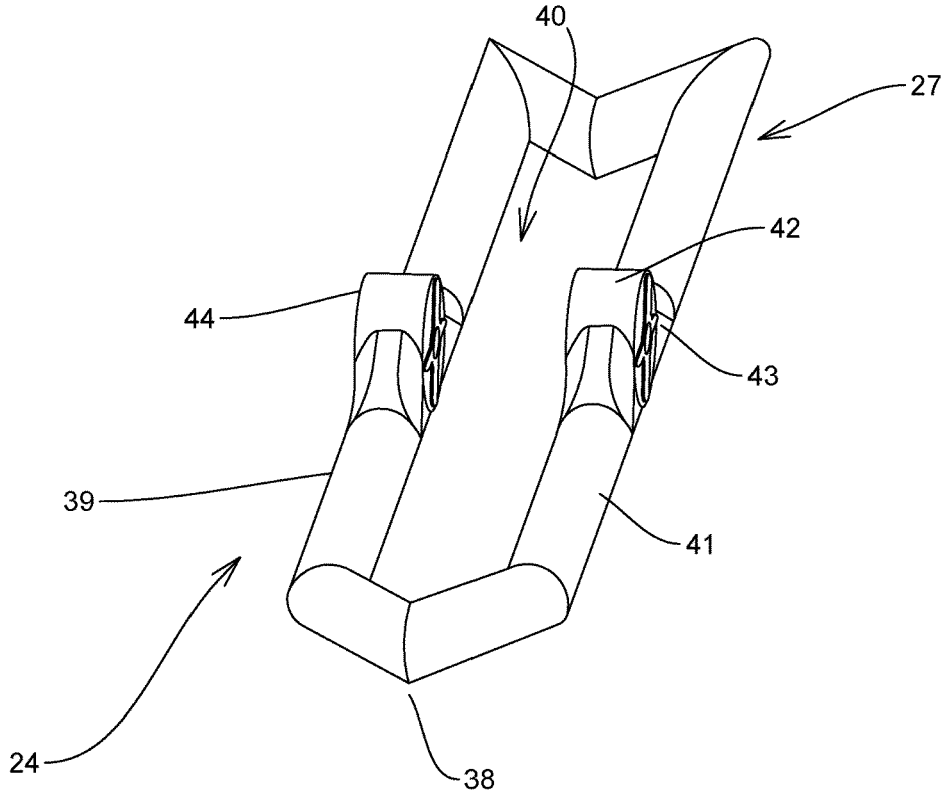
FIG. 2B is a perspective view of a pointer frame, which is a second component of the apparatus of FIG. 1.
Figure 2C:
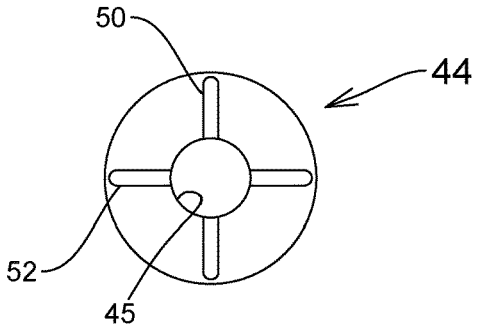
FIG. 2C is a detail side plan view of a boss which is a component part of the pointer frame of FIG. 2B.

In the depicted embodiment, the tee body 22 also includes a plurality of small projections, such as those shown at 29 in FIG. 2A, the projections extending outwardly on the sides of the drum 36, proximate the support posts 28, 30 for selectively engaging recesses 50, 52 (FIG. 2C) of the pointer frame 24, in a manner to be described below.

The pointer frame 24 is provided helping a user align a golf swing, and for pointing the apparatus 20 toward a selected target, which is normally an area of a fairway on a selected golf hole.

The pointer frame 24 may also be referred to as a directional alignment base. A front end of the pointer frame 24 is tapered to a point 38 configured to provide a directional guide for hitting the golf ball GB. The pointer frame 24 is made up primarily of a base frame portion 27 extending around a hollow space 40, and the base frame portion includes two spaced-apart parallel side sections 39, 41, as shown.

The pointer frame 24 also includes a pair of parallel bosses 42, 44 integrally attached to, and extending slightly upwardly from the base frame portion 27, and having cylindrical openings 43, 45 formed respectively therein, the openings configured to slidably receive the support posts 28, 30 of the tee body 22 therein.

The tee body 22 is pivotally connected to the pointer frame 24 at the bosses 42, 44, and is positioned and centered inside of a hollow space 40 formed in the pointer frame 24. The tee body 22 and the pointer frame 24 cooperate to provide a tee assembly 20 configured and arranged for targeting a point down range, when the tee body 22 is inserted into a ground surface with the pointer frame 24 aligned pointing toward a selected target point down range. A golfer can position and swing their club (not shown) directly over and along a target line TL created by the longitudinal axis of the pointer frame 24, striking the teed up golf ball GB to direct the golf ball toward a selected target.

Figure 3:
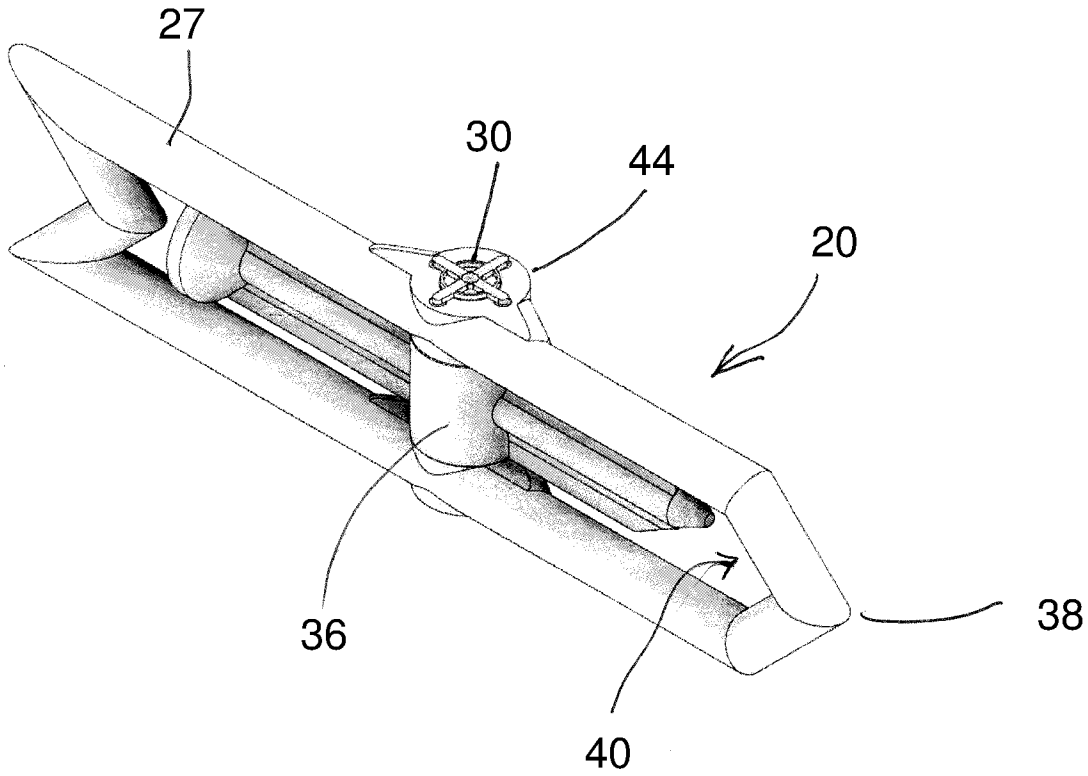
FIG. 3 is a second perspective view of the golf tee apparatus of FIG. 1 shown from below, and with the main tee body shown in a storage position.
Figure 4:
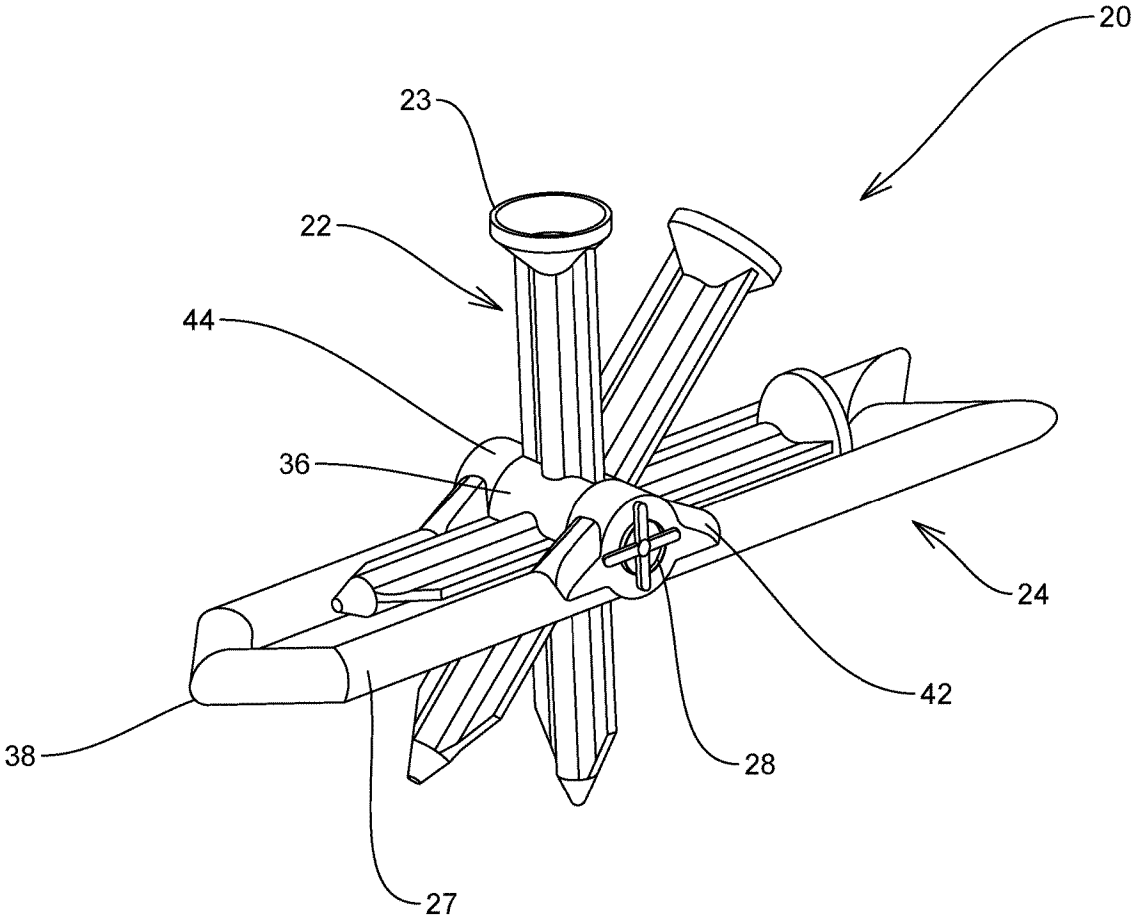
FIG. 4 is a third perspective view of the golf tee apparatus of FIG. 1, with the main tee body shown in three different positions including the working position, the storage position and an intermediate position.

The first component of the apparatus (tee body 22) rotates and locks in two fixed positions within the second component (pointer frame 24). A first locking position locks the first component of the apparatus centered in, and parallel with the second component (the stored position), as shown in FIG. 3.

The second locking position locks the first component centered in and oriented at a 90 degree angle to the second component (the operational position), as shown in FIG. 1. The golf tee apparatus 20 is selectively lockable in the working position thereof, with the consistent 90-degree angle relative to the base, and when the apparatus 20 is inserted into the ground until the pointer frame 24 contacts the ground surface, the tee 20 then sets the golf ball GB at a consistent standardized height.

The pointer frame 24 is centered and positioned directly beneath the teed up ball, acting as a targeting device and an alignment gauge, which the golfer can use to align the path of the golf club to, every time they swing their club. Additionally, the pointer frame 24 acts as a swing guide which the golfer can pass their club over, adjusting their swing plane as needed to the pre-targeted target line TL of the apparatus.

Second Embodiment

Figure 5A:
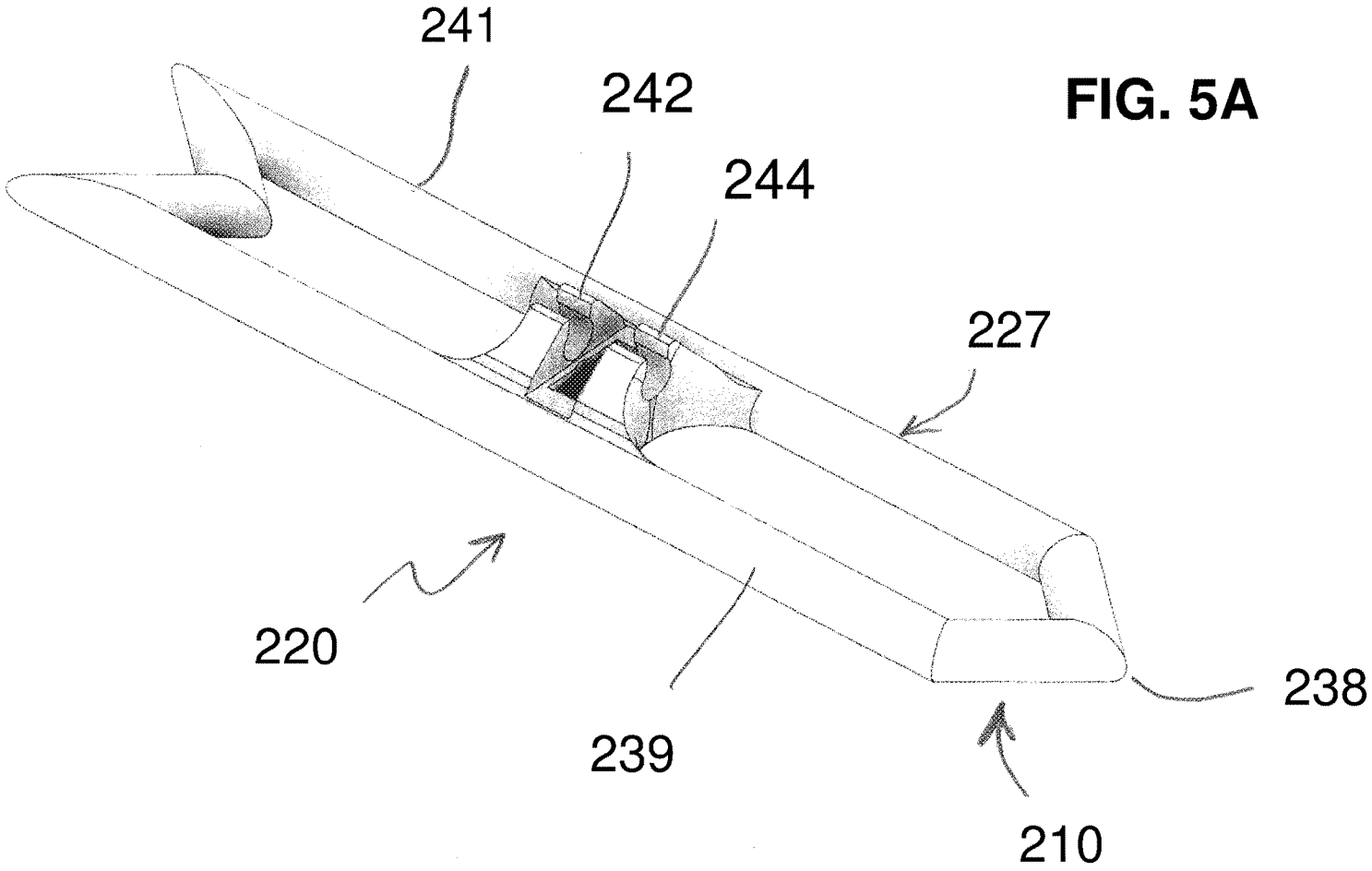
FIG. 5A is a perspective view of a golf swing guide tool according to a second embodiment hereof.
Figure 5B:
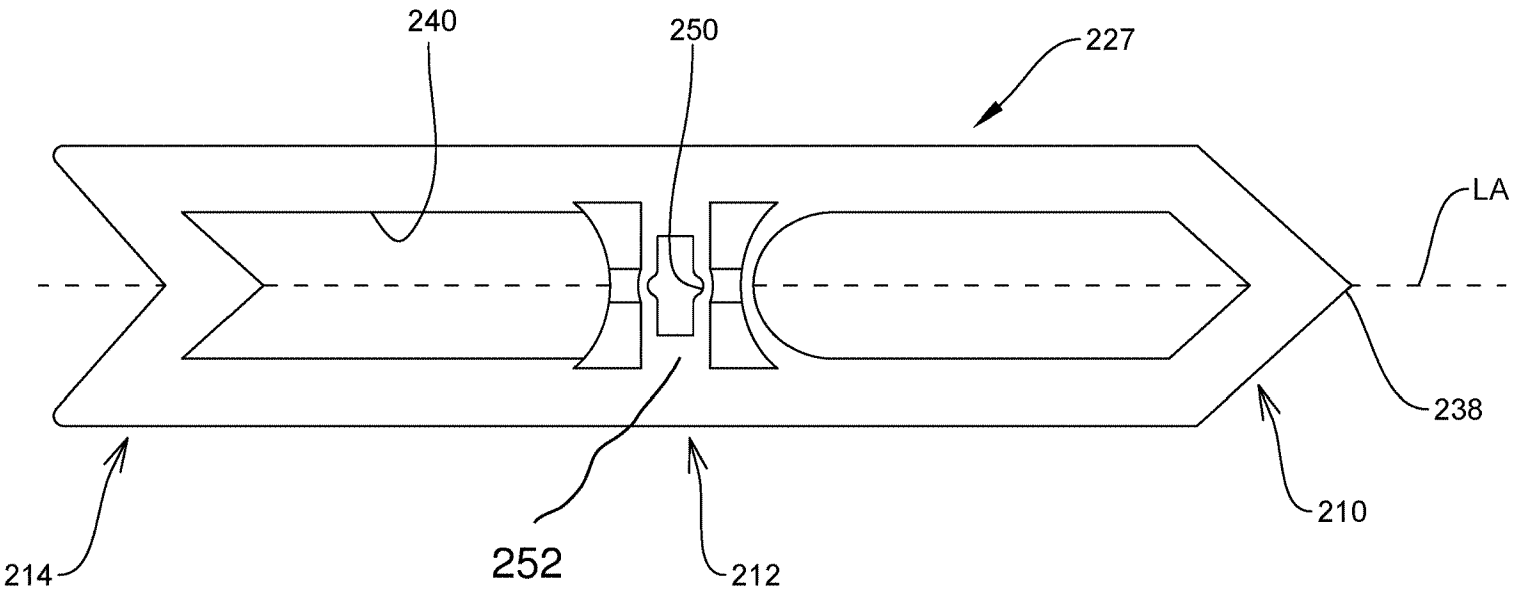
FIG. 5B is a top plan view of the golf swing guide tool of FIG. 5A.
Figure 5C:
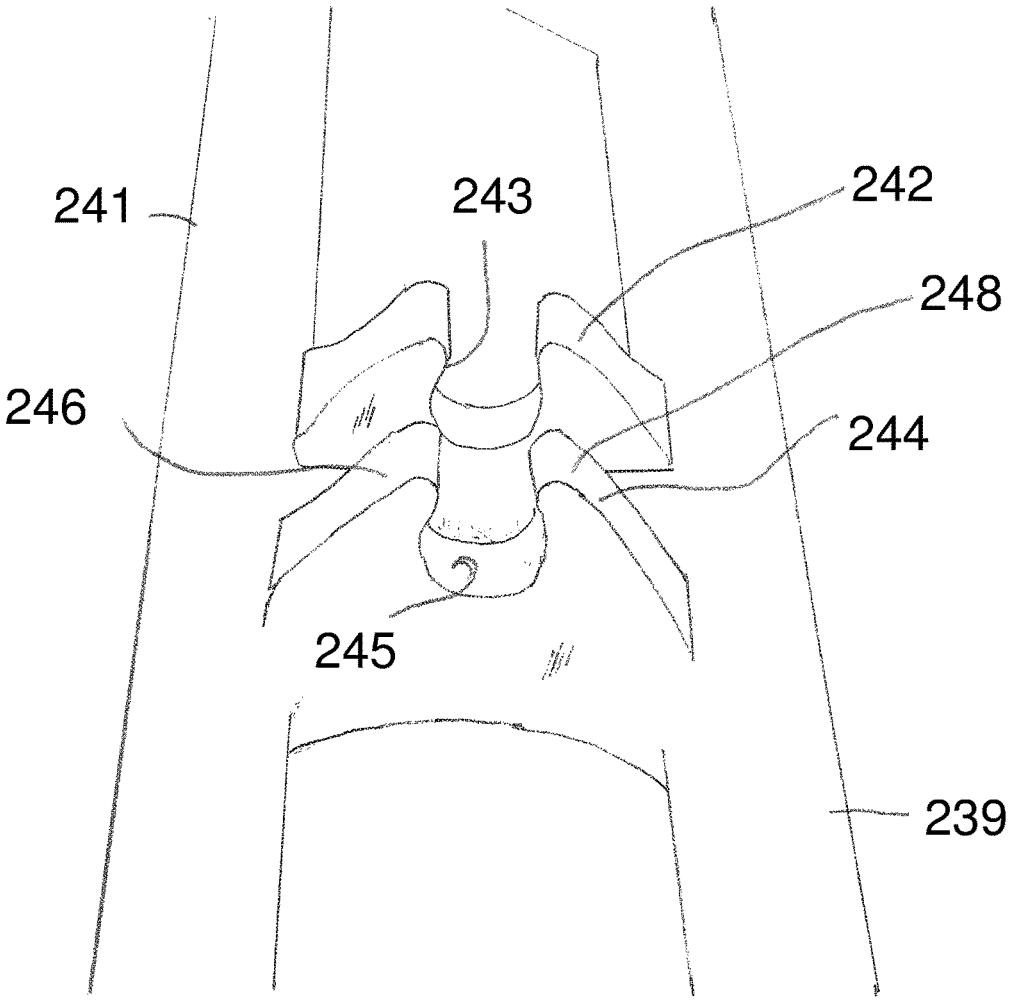
FIG. 5C is a detail perspective view of a central portion of the golf swing guide tool of FIG. 5A.
Figure 6:
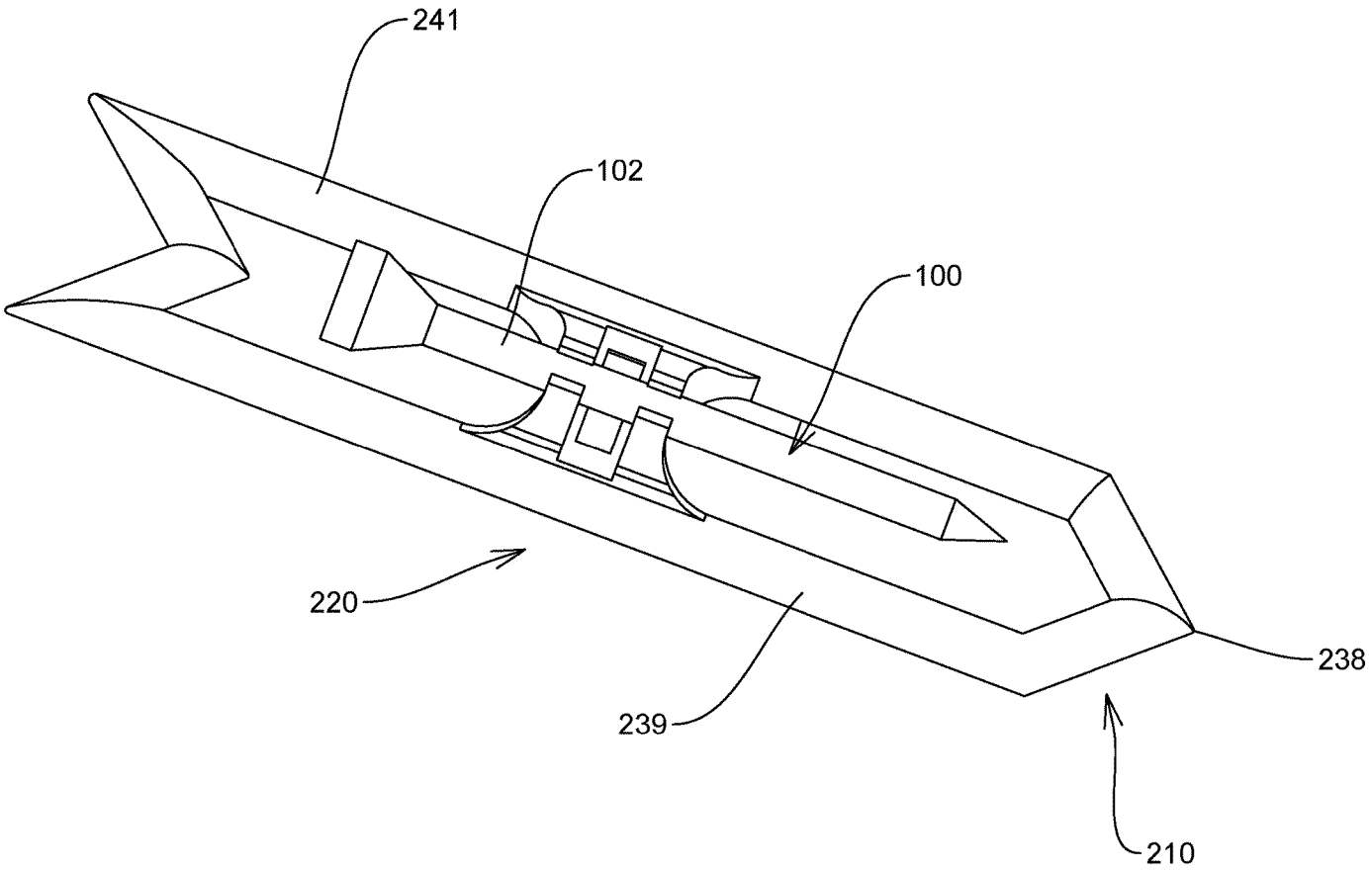
FIG. 6 is a perspective view of the golf swing guide tool of FIG. 5A, with a golf tee attached thereto in a parallel storage position.
Figure 7:
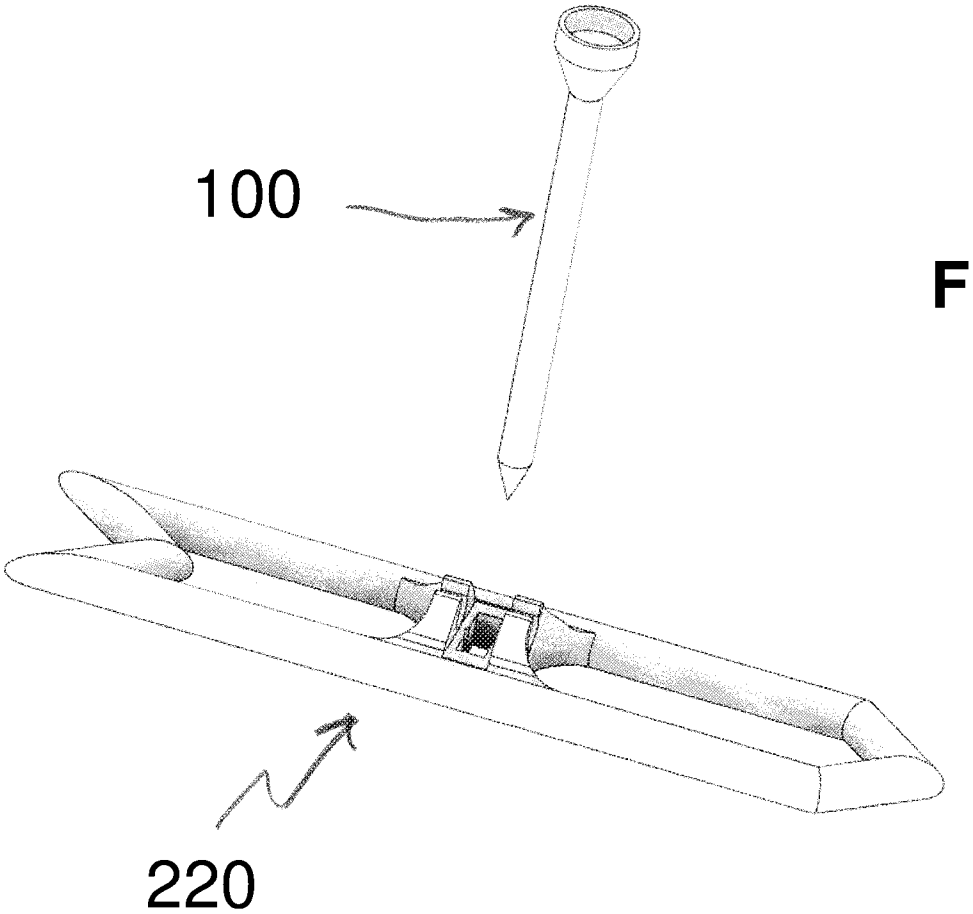
FIG. 7 is a perspective view of the golf swing guide tool of FIG. 5A, with a golf tee shown above the apparatus and about to be inserted therethrough.

Referring now to FIGS. 5A-5C of the drawings, a golf swing alignment tool according to a second illustrative embodiment of the invention is shown generally at 220. As shown in FIGS. 6-7, the golf swing alignment tool 220 according to this embodiment can be used with a conventional golf tee 100, and may, optionally, be sold in a kit, in which the swing guide tool 220 is sold together with a tee.

FIG. 6 is a perspective view of the golf swing guide tool 220 of FIG. 5, with a golf tee 100 shown, removably attached thereto, in a parallel storage position.

The golf swing guide tool 220 is provided for helping a user align a golf swing, and for pointing toward a selected target, which is normally an area of a fairway on a selected golf hole. The golf swing guide tool 220 includes a pointer body or base frame member 227, which may also be referred to as a directional alignment base. The pointer body 227 has a central longitudinal axis LA (FIG. 5B), which is intended to act as a guide for a user, and along which the user is encouraged to move his or her golf club head during a swing.

Figure 8:
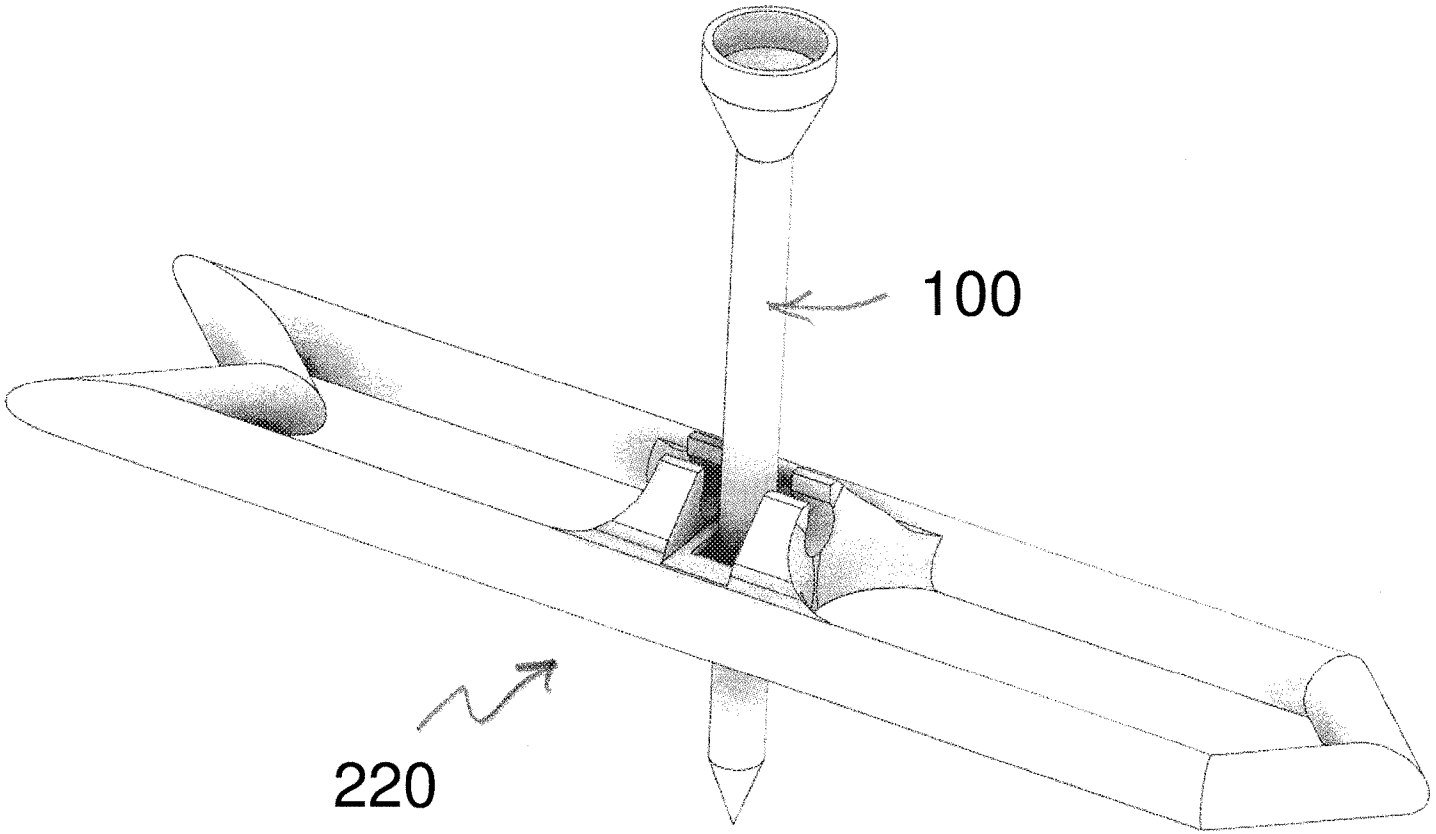
FIG. 8 is a perspective view of the golf swing guide tool of FIG. 5A, with a golf tee inserted perpendicularly therethrough in preparation for use.
Figure 9:
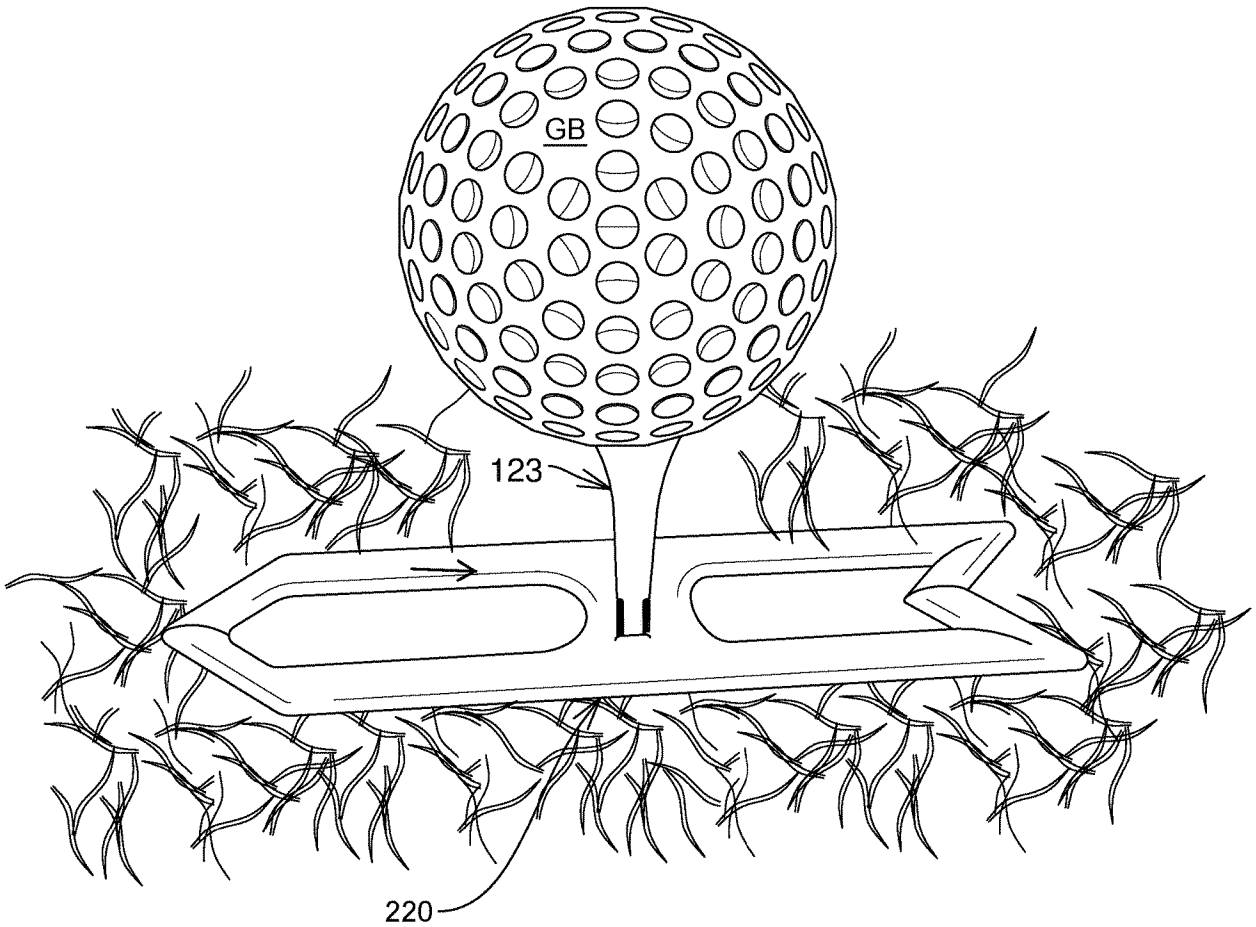
FIG. 9 is an environmental perspective view similar to FIG. 8 with a lower part of the golf tee inserted into the ground in preparation for use, with the structure simplified for purposes of illustration, and with a golf ball shown resting on top of the tee.

The pointer body 227 has a front end 210, a medial portion 212 and a rear portion 214, the medial portion including a bridge 252 extending across the pointer body, as shown, and having the central hole 250 formed therein. The central hole 250 is aligned with the longitudinal axis LA and configured to slidably receive a shaft portion 102 of a golf tee 100 therein to form a working configuration in which the tee 100 is oriented substantially perpendicular to the longitudinal axis LA of the pointer body 227. This working configuration is shown in FIGS. 8 and 9 of the drawings.

The front end 210 of the pointer body 227 is tapered to a central point 238, which is disposed along the longitudinal axis LA and configured to provide a directional guide for showing a user a direction in which to hit a golf ball GB. The golf swing guide tool 220 includes the base frame portion 227 extending around a hollow space 240, and the base frame portion includes two spaced-apart parallel side sections 239, 241, as shown. The base frame portion 227 further includes the front end 210 and a rear portion 214 connecting the two side sections 239, 241.

The golf swing guide tool 220 also includes a pair of parallel bosses 242, 244 supported on top of the bridge 252 and extending across the base frame 227 portion substantially parallel to one another. The central hole 250 (FIG. 5B) is formed in the middle of the bridge 252 between the bosses 242, 244. The bosses 242, 244 may be formed from a flexibly resilient material. The central hole 250 is configured to receive a shaft portion of the tee 100 therein in a working configuration (shown in FIGS. 8-9) of the swing guide apparatus 220, in which the tee shaft 102 is oriented substantially parallel to the longitudinal axis LA of the pointer body 227.

The bosses 242, 244 are integrally attached to, and extend slightly upwardly from the base frame portion 227, and each of the bosses has a cylindrical opening 243, 245 (FIG. 5C) formed respectively therein, the openings configured to slidably receive the shaft portion 102 of the tee 100 therein in a storage configuration (shown in FIG. 6), in which the tee is oriented substantially parallel to the longitudinal axis LA of the pointer body 227. Each boss 242, 244, as exemplified by boss 244 in FIG. 5C includes a pair of spaced-apart clip members 246, 248 on opposite sides of the corresponding cylindrical opening 245.

As shown by a comparison of FIG. 6 and FIG. 8, a kit, including the golf swing guide tool 220 hereof and a golf tee 100, is adjustable between a storage position, shown in FIG. 6, and a working position shown in FIG. 8.

Figure 10:
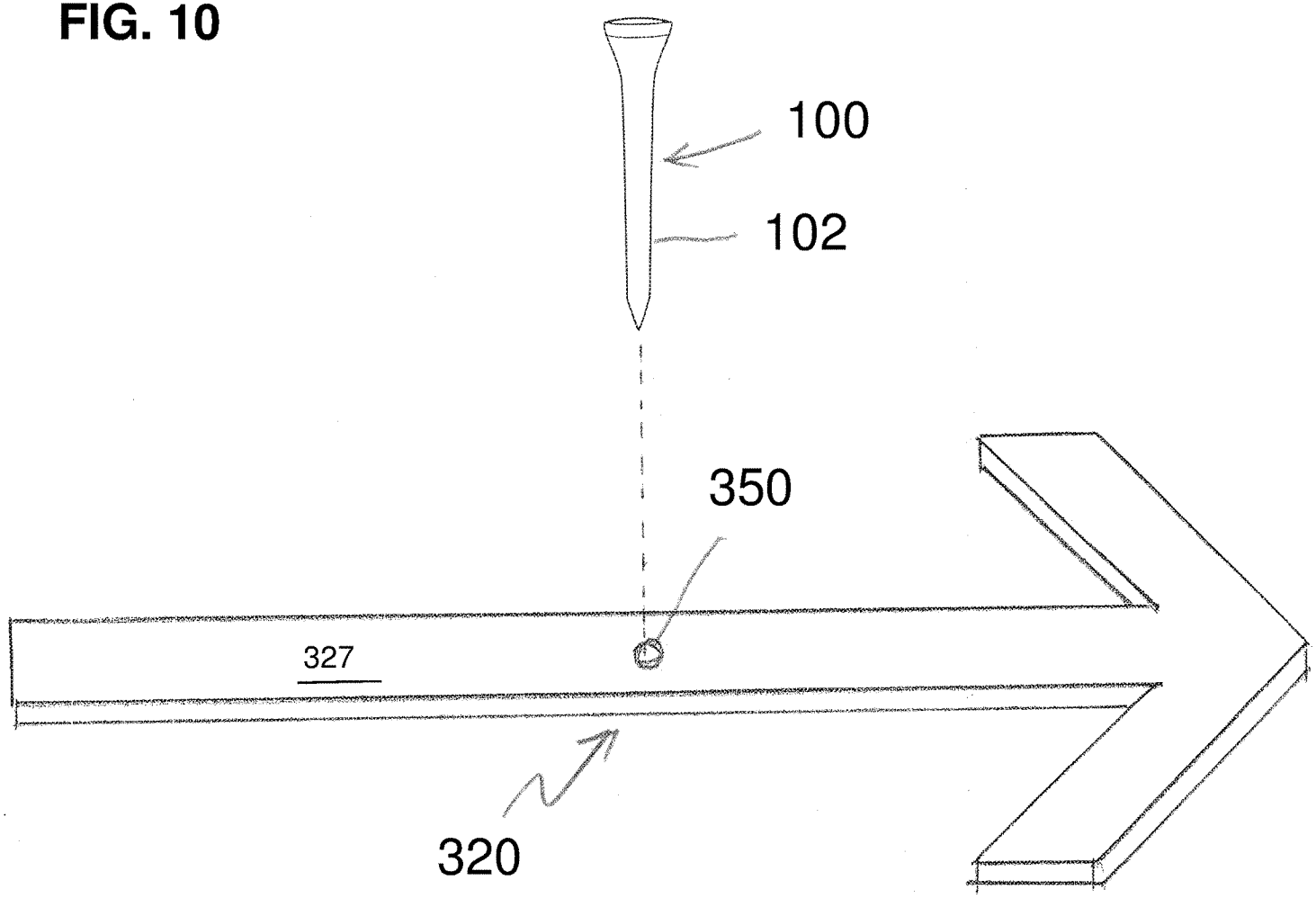
FIG. 10 is a perspective view of a simplified golf swing guide tool according to a third embodiment of the invention, with a golf tee shown above the apparatus and about to be inserted therethrough.
Figure 11:
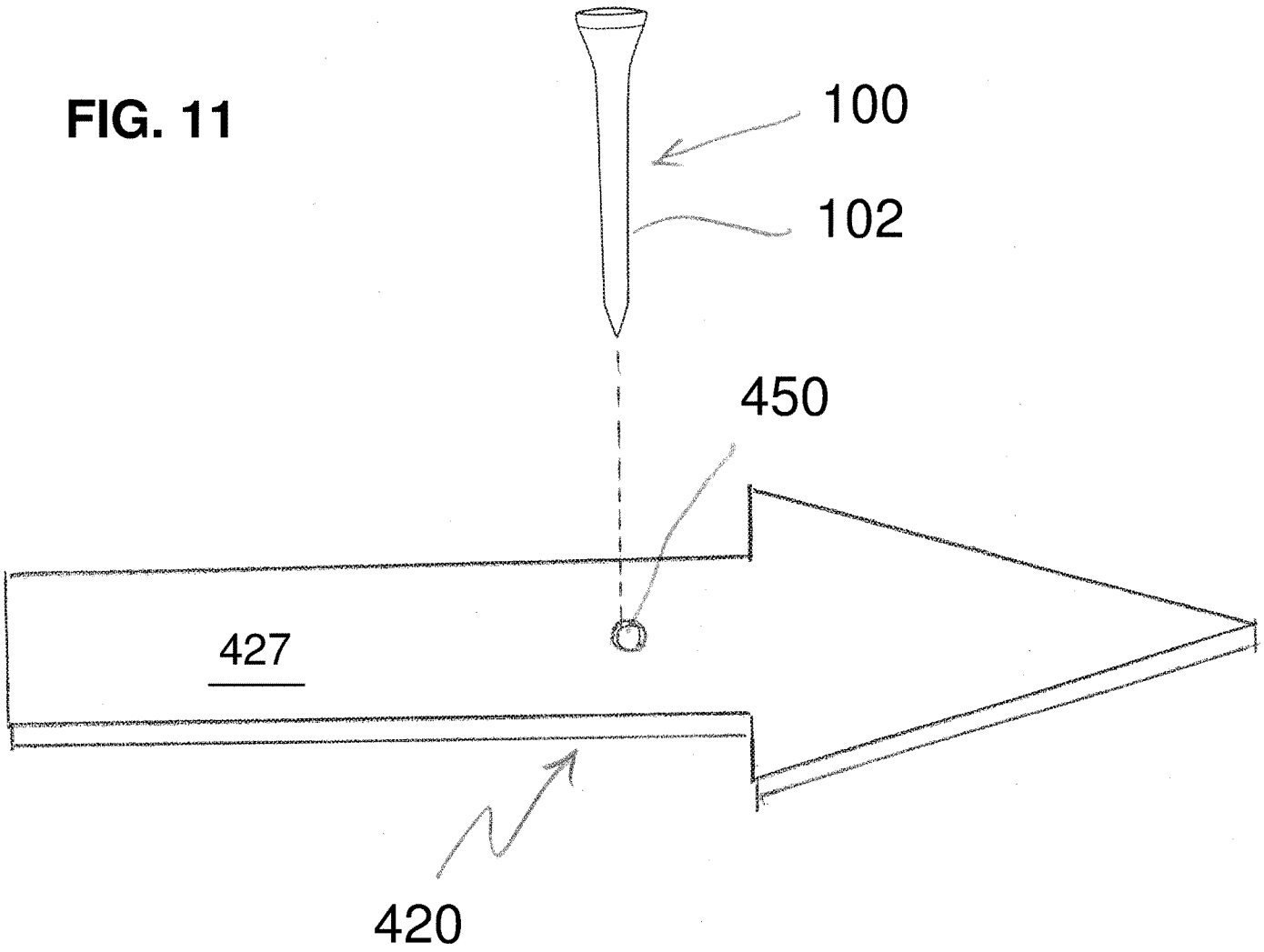
FIG. 11 is a perspective view of a simplified golf swing guide tool according to a fourth embodiment of the invention, with a golf tee shown above the apparatus and about to be inserted therethrough.

Two other simplified embodiments of golf swing guide tools 320, 420 according to the present invention are shown in FIGS. 10 and 11. Each of these simplified embodiments includes a generally flattened, platelike pointer body 327, 427, respectively, having a central hole 350, 450 formed therein to receive a shaft portion 102 of a golf tee 100 therein via a friction fit.

Method

A further aspect of the present invention relates to a method of hitting a golf ball off of a golf tee 100 mounted in the golf swing guide tool 220 in the working configuration thereof.

Figure 12:
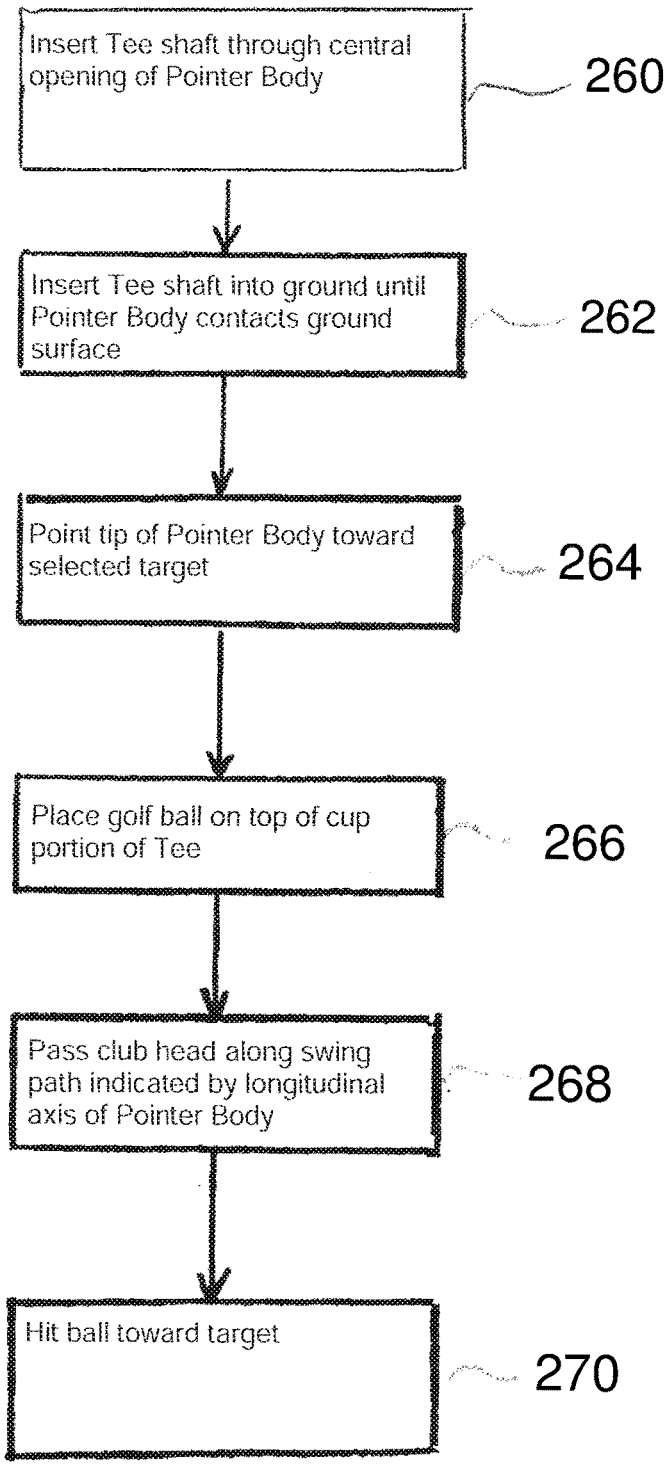
FIG. 12 is a simplified flow chart showing steps in a method of using the apparatus of FIG. 5A with a golf tee.

The method includes a first step of arranging the apparatus with the shaft portion 102 of the tee 100 inserted through the central hole 250 and oriented substantially vertically, as shown in FIG. 8. This step is shown at 260 in FIG. 12.

The method includes a second step of inserting the shaft 102 of the tee 100 into a selected ground area until the pointer body contacts the ground surface. This step is shown at 262 in FIG. 12.

The method includes a third step of orienting the pointer body in a direction facing toward a selected target, whereby the pointer body functions as a targeting device and an alignment gauge for aligning a swing path of a golf club, a portion of the swing path being substantially aligned with the longitudinal axis of the pointer body. This step is shown at 264 in FIG. 12.

The method also includes a fourth step of placing a golf ball GB on to a cup portion 123 of the tee. This step is shown in FIG. 9 and also at 266 in FIG. 12.

The method also includes a fifth step of passing the golf club over the swing path indicated by the pointer body. This step is shown at 268 in FIG. 12.

The method also includes a final step of hitting the golf ball off of the golf tee apparatus and toward the target. This step is shown at 270 in FIG. 12.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the present description, are intended to be within the scope and spirit of the present invention.

What is claimed is:

1. A golf swing guide tool configured for use with a golf tee, said swing guide tool comprising:

an elongated pointer body having a front end, a medial portion and a rear end, the pointer body having a longitudinal axis, the front end being tapered to a point at a tip portion thereof which is disposed on the longitudinal axis, the medial portion having a central hole formed therein which is aligned with the longitudinal axis and which is configured to slidably receive a shaft portion of a golf tee therein to form a working configuration in which the tee is oriented substantially perpendicular to the longitudinal axis of the pointer body, wherein the pointer body comprises:

a base frame portion extending around a hollow space, the base frame portion including two spaced-apart parallel side sections, two front segments extending forwardly from the side sections and converging to form the front end, and a rear segment connecting rearward end portions of the side sections, a bridge extending between and connecting the side sections at the medial portion, the bridge having the central hole formed therein, and at least one boss formed from a flexibly resilient material, the boss attached to the bridge at the medial portion of the pointer body and extending outwardly thereon, the boss comprising two spaced apart clip members defining a space therebetween configured to receive the shaft of the golf tee in a storage configuration in which the tee is oriented substantially parallel to the longitudinal axis of the pointer body.

2. The golf swing guide tool of claim 1, wherein the at least one boss comprises a pair of bosses formed proximate the medial portion of the base frame portion and cooperating to define at least one hollow aperture therebetween to receive the shaft of the tee therein, the hollow aperture disposed inside of said hollow space, wherein the bosses are formed integrally with the base frame portion of the pointer body.

3. A golf swing guide tool configured for use with a golf tee, said swing guide tool comprising:

an elongated pointer body having a front end, a medial portion and a rear end and having a longitudinal axis, the front end being tapered to a point at a tip portion thereof which is disposed on the longitudinal axis, the medial portion having a central hole formed therein which is aligned with the longitudinal axis and which is configured to slidably receive a shaft portion of a golf tee therein to form a working configuration in which the tee is oriented substantially perpendicular to the longitudinal axis of the pointer body; and at least one boss formed from a flexibly resilient material, the boss attached to the medial portion of the pointer body and extending outwardly therefrom, the boss comprising two spaced apart clip members defining a space therebetween configured to receive the shaft of the golf tee in a storage configuration in which the tee is oriented substantially parallel to the longitudinal axis of the pointer body, wherein the pointer body comprises:

a base frame portion extending around a hollow space, the base frame portion including two spaced-apart parallel side sections, two front segments extending forwardly from the side sections and converging to form the front end, and a rear segment connecting rearward end portions of the side sections.

4. The golf swing guide tool of claim 3, wherein the at least one boss comprises a pair of bosses formed proximate the medial portion of the base frame portion and cooperating to define at least one hollow aperture formed in the pointer body to receive the shaft of the tee therein, the hollow aperture disposed inside of said hollow space, wherein the bosses are formed integrally with the base frame portion of the pointer body.

5. A method of hitting a golf ball off of a golf tee mounted in the golf swing guide tool of claim 1 in said working configuration, said method comprising the steps of:

arranging the golf swing guide tool with the shaft portion of the tee inserted through the central hole and oriented substantially vertically;

inserting the shaft of the tee into a selected ground area until the pointer body contacts the ground surface;

orienting the pointer body of the golf swing guide tool in a direction facing toward a selected target, whereby the pointer body functions as a targeting device and an alignment gauge for aligning a swing path of a golf club, a portion of the swing path being substantially aligned with the longitudinal axis of the pointer body;

placing a golf ball on a cup portion of the tee;

passing the golf club over the swing path indicated by the pointer body, and hitting the golf ball off of the golf tee apparatus and toward the target.

* * * * *